US012654967B2

(12) United States Patent
Takano

(10) Patent No.: US 12,654,967 B2
(45) Date of Patent: Jun. 16, 2026

(54) SHEET CONVEYING DEVICE AND IMAGE FORMING APPARATUS INCORPORATING SAME

(71) Applicant: Satoru Takano, Kanagawa (JP)

(72) Inventor: Satoru Takano, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 18/812,212

(22) Filed: Aug. 22, 2024

(65) Prior Publication Data

US 2025/0083914 A1 Mar. 13, 2025

(30) Foreign Application Priority Data

Sep. 12, 2023 (JP) ..... 2023-147825

(51) Int. Cl.
*B65H 5/06* (2006.01)

(52) U.S. Cl.
CPC ..... *B65H 5/062* (2013.01); *B65H 2404/1422* (2013.01); *B65H 2801/06* (2013.01)

(58) Field of Classification Search
CPC ..... B65H 5/06; B65H 5/062; B65H 2402/45; B65H 2402/60; B65H 2601/30; B65H 2601/32; B65H 2601/321; B65H 2601/324
See application file for complete search history.

(56) References Cited

U.S. PATENT DOCUMENTS

| | | | | |
|---|---|---|---|---|
| 5,765,825 | A * | 6/1998 | Watase | B65H 1/08 271/9.13 |
| 8,478,165 | B2 * | 7/2013 | Somemiya | G03G 21/1647 399/124 |
| 9,592,975 | B2 * | 3/2017 | Ishikawa | B65H 5/26 |
| 9,983,535 | B2 * | 5/2018 | Ozawa | G03G 21/1647 |
| 2012/0099896 | A1 * | 4/2012 | Kamano | G03G 21/1638 399/121 |
| 2014/0145395 | A1 | 5/2014 | Takano et al. | |
| 2017/0174458 | A1 | 6/2017 | Takano et al. | |

FOREIGN PATENT DOCUMENTS

| | | | |
|---|---|---|---|
| JP | 2007298695 | A | 11/2007 |
| JP | 2014232253 | A | 12/2014 |
| JP | 2021059419 | A | 4/2021 |

* cited by examiner

*Primary Examiner* — Patrick Cicchino
(74) *Attorney, Agent, or Firm* — Harness, Dickey & Pierce, P.L.C.

(57) ABSTRACT

A sheet conveying device includes an opening-and-closing member, a pressing member, a hook, a biasing member, and an adjuster. The opening-and-closing member has a lower end to be supported by an apparatus body and is rotatable. The pressing member is disposed in the opening-and-closing member to press a pressed member of the apparatus body. The hook engages with an engaging member of the apparatus body to hold the opening-and-closing member at a closing position of the opening-and-closing member. The biasing member biases the hook in a direction to maintain engagement of the hook. The adjuster adjusts at least one of a pressing force of the pressing member or a protrusion amount of the pressing member with respect to a surrounding member of the pressing member. The hook rotates against a biasing force of the biasing member to ride over the engaging member and engage with the engaging member.

20 Claims, 14 Drawing Sheets

SHEET CONVEYING DEVICE AND IMAGE FORMING APPARATUS INCORPORATING SAME

CROSS-REFERENCE TO RELATED APPLICATION

This patent application is based on and claims priority pursuant to 35 U.S.C. § 119(a) to Japanese Patent Application No. 2023-147825, filed on Sep. 12, 2023, in the Japan Patent Office, the entire disclosure of which is hereby incorporated by reference herein.

BACKGROUND

Technical Field

Embodiments of the present disclosure relate to a sheet conveying device and an image forming apparatus incorporating the sheet conveying device.

Related Art

A sheet conveying device is known that includes an opening-and-closing member, a pressing member, and a hook. A lower end of the opening-and-closing member is supported by an apparatus body to be rotatable. The opening-and-closing member opens and closes a sheet conveyance path. The pressing member presses a pressed member of the apparatus body and is disposed in the opening-and-closing member. The hook engages with an engaging member of the apparatus body and holds the opening-and-closing member at a closing position.

A sheet conveying device is also known that includes a cover as an opening-and-closing member. The cover is supported by an apparatus body to be rotatable around a lower end of the cover and opens and closes a reverse conveyance path as a sheet conveyance path.

SUMMARY

In an embodiment of the present disclosure, a sheet conveying device includes an opening-and-closing member, a pressing member, a hook, a biasing member, and an adjuster. The opening-and-closing member has a lower end to be supported by an apparatus body and is rotatable to open and close a sheet conveyance path. The pressing member is disposed in the opening-and-closing member to press a pressed member of the apparatus body. The hook engages with an engaging member of the apparatus body to hold the opening-and-closing member at a closing position at which the opening-and-closing member closes the sheet conveyance path. The biasing member biases the hook in a direction to maintain engagement of the hook with the engaging member. The adjuster adjusts at least one of a pressing force of the pressing member or a protrusion amount of the pressing member with respect to a surrounding member of the pressing member. The hook rotates against a biasing force of the biasing member, while sliding on the engaging member, to ride over the engaging member and engage with the engaging member.

In another embodiment of the present disclosure, an image forming apparatus includes the sheet conveying device.

BRIEF DESCRIPTION OF THE DRAWINGS

A more complete appreciation of embodiments of the present disclosure and many of the attendant advantages and features thereof can be readily obtained and understood from the following detailed description with reference to the accompanying drawings, wherein.

Figure 1:
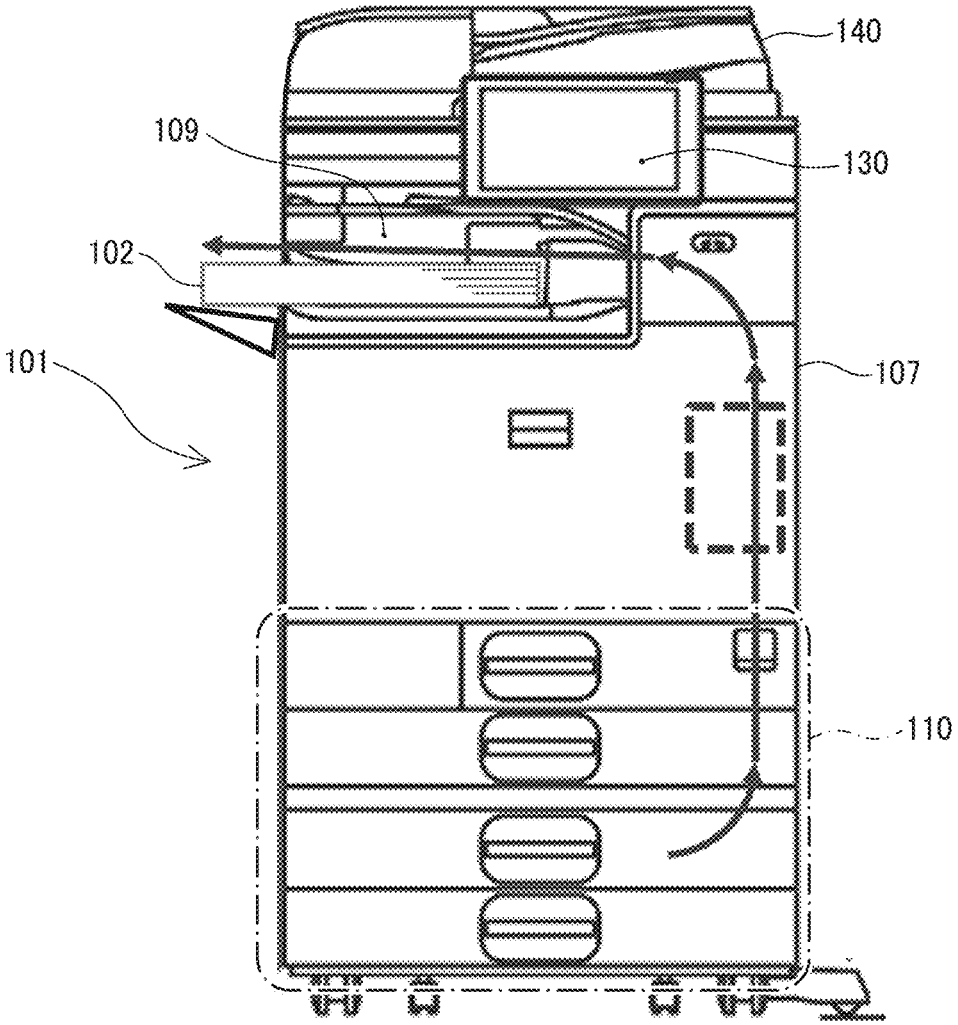
FIG. 1 is a front view of an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted. Also, identical or similar reference numerals designate identical or similar components throughout the several views.

DETAILED DESCRIPTION

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

Referring now to the drawings, embodiments of the present disclosure are described below. As used herein, the singular forms "a," "an," and "the" are intended to include the plural forms as well, unless the context clearly indicates otherwise.

Descriptions below are given of a sheet conveying device and an image forming apparatus, according to embodiments of the present disclosure, with reference to the accompanying drawings. Note that it is easy for a person skilled in the art to modify or amend the present disclosure within the scope of the claims to form another embodiment, and these modifications or amendments are included in the scope of the claims. The following description is an example of the best mode of the present disclosure and does not limit the scope of the claims.

FIG. 1 is a front view of an image forming apparatus 101 according to the present embodiment. As illustrated in FIG. 1, an image forming apparatus 101 includes an image forming device 107, a sheet feeder 110 disposed below the image forming device 107, and an image reading device 140 disposed above the image forming device 107. The image forming apparatus 101 further includes a control panel 130 on which operations and displays for an operator are displayed to perform image formation. As indicated by the arrows in FIG. 1, a sheet fed from the sheet feeder 110 is conveyed vertically upward. After an image is formed on the sheet by the image forming device 107, the sheet is ejected to a sheet ejection unit 109.

Figure 2:
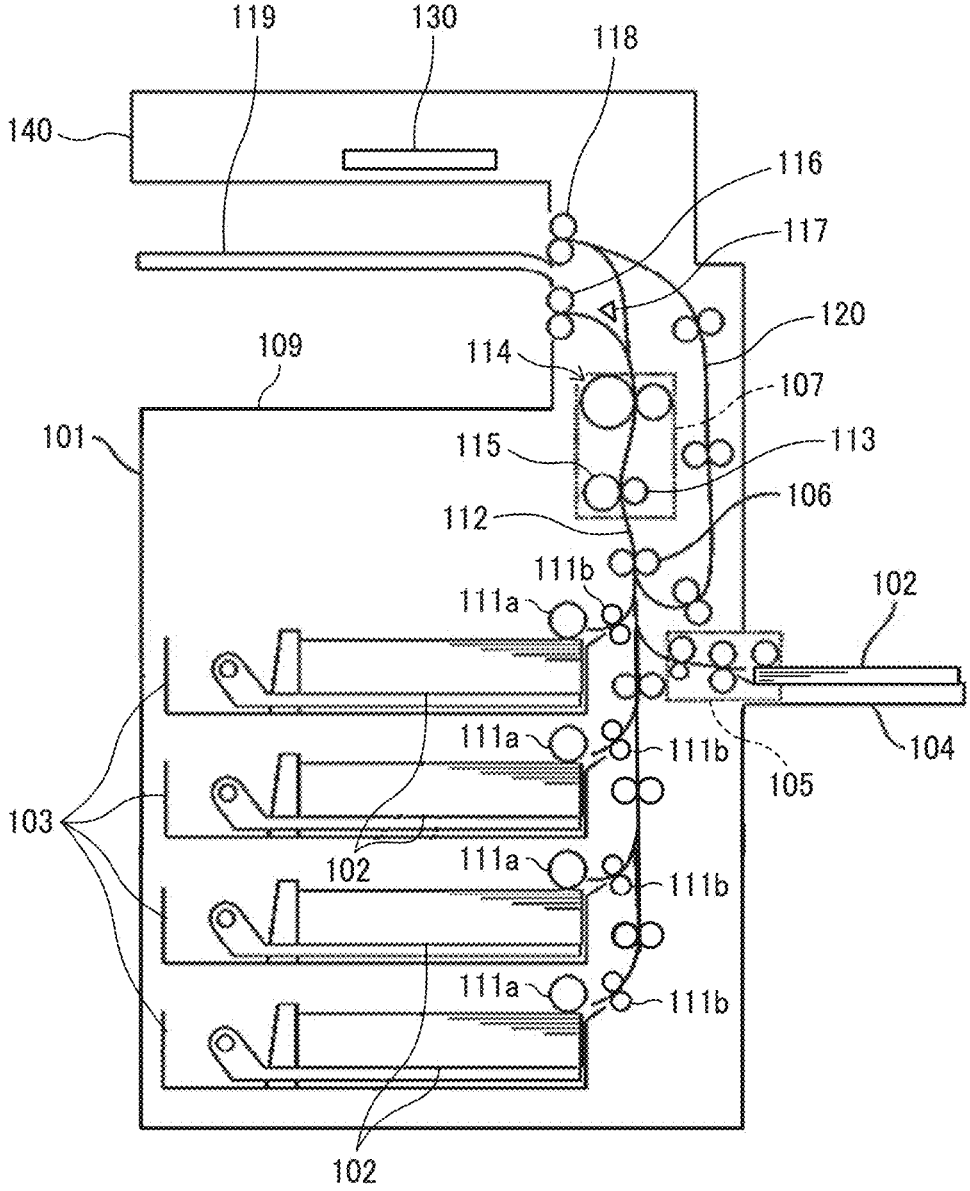
FIG. 2 is a schematic view of an interior of the image forming apparatus in FIG. 1.

FIG. 2 is a schematic view of an internal structure of the image forming apparatus 101. The sheet feeder 110 includes four sheet trays 103 each serving as a sheet stacker detachably attached to an apparatus body. The sheet trays 103 are vertically disposed and store different types of sheets 102 from each other. The sheets 102 stacked on the sheet tray 103 are fed from the sheet tray 103 by a sheet feeding roller 111*a*, separated into one sheet by a separation roller pair 111*b*, and then fed to a sheet conveyance path 112 extending in a substantially up-and-down (vertical) direction to the sheet ejection unit 109.

A bypass sheet tray 104 serving as a sheet stacker is disposed on the right side face of the apparatus body in FIG. 2. The sheets 102 stacked on the bypass sheet tray 104 are fed by a bypass sheet feeder 105 to the sheet conveyance path 112.

The image forming device 107 includes a photoconductor 115 serving as an image bearer. A charging device, a developing device, a transfer roller 113, and a cleaning unit are disposed around the photoconductor 115. The charging device uniformly charges the photoconductor 115. The developing device supplies toner onto an electrostatic latent image formed on the surface of the photoconductor 115 to develop the electrostatic latent image into a visible toner image. The transfer roller 113 transfers the toner image formed by the developing device onto the sheet 102 that is conveyed to the transfer roller 113. The cleaning unit cleans the photoconductor 115 by removing residual toner remaining on the surface of the photoconductor 115 after the transfer of the toner image.

The image forming device 107 further includes an optical writing device that forms an electrostatic latent image on the surface of the photoconductor 115. The optical writing device emits laser light to irradiate the surface of the photoconductor 115 based on image data of an original document read by the image reading device 140 or image data input via a personal computer (PC) to optically write the image data by the optical writing device, so that an electrostatic latent image is formed on the surface of the photoconductor 115.

The image forming device 107 further includes a fixing device 114 disposed downstream from the transfer roller 113 in the sheet conveyance direction. The fixing device 114 fixes the toner image to the sheet 102 by the transfer roller 113 by application of heat and pressure to the toner image on the sheet 102.

The sheet 102 is selectively fed from any one of the sheet trays 103 and the bypass sheet tray 104 and is conveyed in the sheet conveyance path 112. The sheet 102 conveyed to the sheet conveyance path 112 is temporarily stopped by a registration roller pair 106 disposed upstream from the transfer roller 113 in the sheet conveyance direction, so that the posture of the sheet 102 is corrected. Thereafter, the sheet 102 is conveyed at a specified timing by the registration roller pair 106 to a transfer nip region formed between the transfer roller 113 and the photoconductor 115. The toner image on the photoconductor 115 is transferred onto the sheet 102 at the transfer nip region.

The sheet 102 on which the toner image transferred in the transfer nip region is conveyed to the fixing device 114, and the toner image transferred onto the sheet 102 is fixed to the sheet 102 by application of heat and pressure in the fixing device 114. After the fixing operation, the sheet 102 is conveyed by a sheet ejection roller pair 116 to be ejected to the sheet ejection unit 109 disposed outside the image forming apparatus 101.

The image forming apparatus 101 according to the present embodiment can perform duplex printing as well as single-side printing. In duplex printing for printing toner images on both sides of a sheet 102, the toner image is fixed to the front of the sheet 102, then a branching claw 117 is switched to change the sheet conveyance path to convey the sheet 102 toward a reverse roller pair 118.

The reverse roller pair 118 ejects the sheet 102 in the middle of the sheet conveyance path to a sheet reverse tray 119, reverses the sheet 102, and conveys the sheet 102 to a duplex sheet conveyance path 120. After having been conveyed to the duplex sheet conveyance path 120, the sheet 102 is conveyed to the position of the registration roller pair 106 again in the state where the front and back sides of the sheet 102 are reversed.

After the toner image has been transferred from the photoconductor 115 onto the back side of the sheet 102 that is conveyed from the registration roller pair 106 to the transfer nip region, the toner image is fixed to the sheet 102 in the fixing device 114, and ejected to the sheet ejection unit 109 by the sheet ejection roller pair 116.

Figure 3:
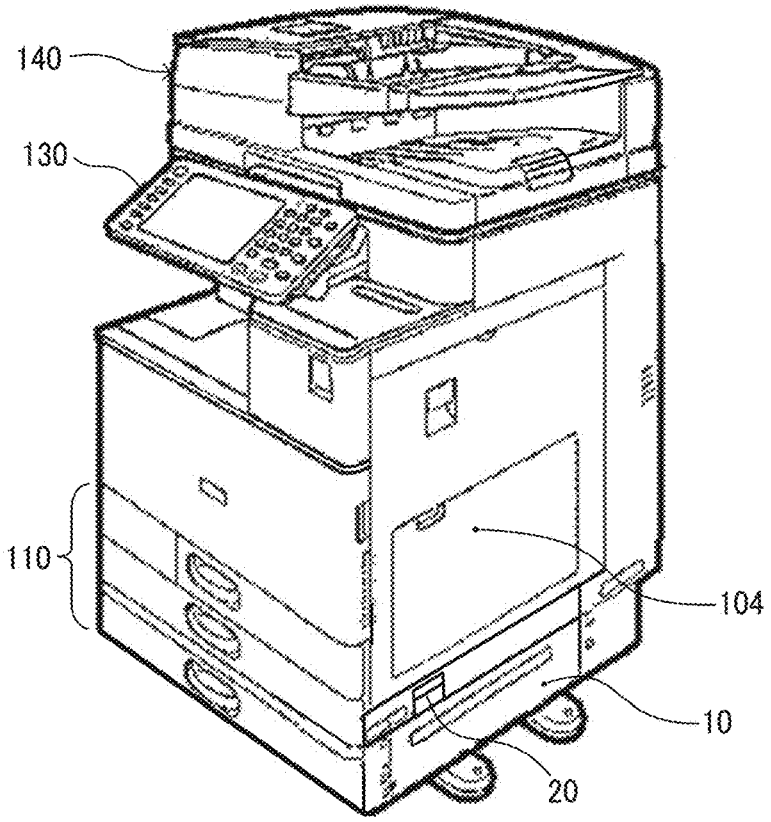
FIG. 3 is a perspective view of the image forming apparatus in FIG. 1.
Figure 4:
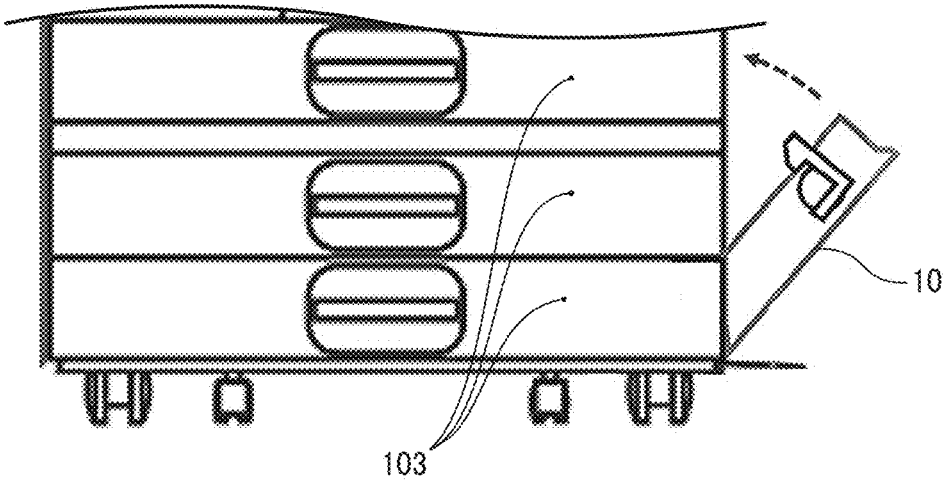
FIG. 4 is a view of a sheet feeder with an opening-and-closing cover opened.

FIG. 3 is a perspective view of the image forming apparatus 101. As illustrated in FIG. 3, an opening-and-closing cover 10 as an opening-and-closing member is disposed on a side face of the image forming apparatus 101 on which the bypass sheet tray 104 is disposed to be openable and closable. As illustrated in FIG. 4, when a handle 20 is operated, the opening-and-closing cover 10 is opened, a sheet conveyance path of the sheet feeder 110 is exposed, and the sheet 102 jammed in the sheet feeder 110 can be removed.

Figure 5:
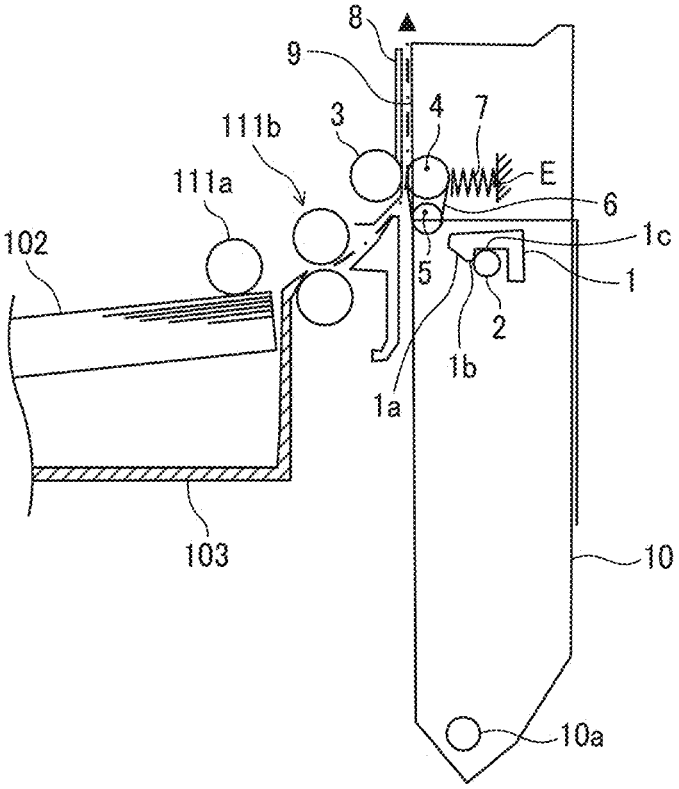
FIG. 5 is a schematic view of a sheet feeder with an opening-and-closing cover closed.
Figure 6:
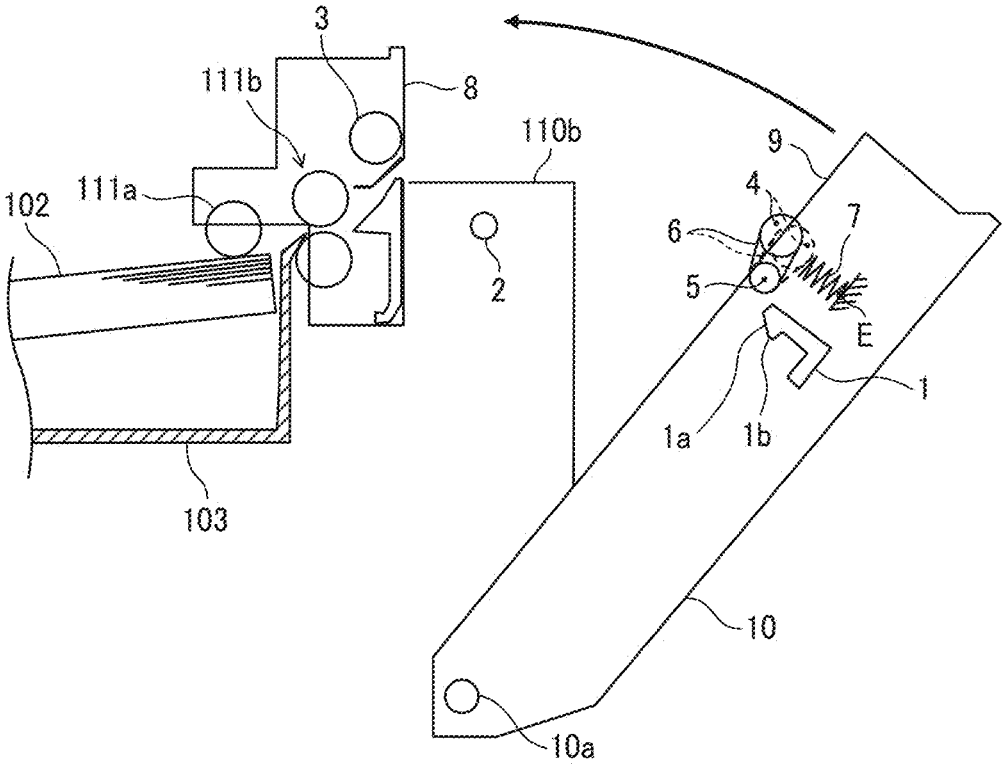
FIG. 6 is a schematic view of the sheet feeder of FIG. 5 with the opening-and-closing cover opened.

FIG. 5 is a schematic view of the closed opening-and-closing cover 10. FIG. 6 is a schematic view of the opened opening-and-closing cover 10. A support shaft 10*a* supported to be rotatable by the apparatus body is disposed at the lower end of the opening-and-closing cover 10. The opening-and-closing cover 10 includes a conveying belt 6 stretched between a pressure roller 4 as a pressing member and a driving roller 5. The pressure roller 4 is biased toward the apparatus body by a compression spring 7 and contacts a conveying roller 3, which is a member to be pressed of the apparatus body, via the conveying belt 6, to form a conveyance nip.

The pressure roller 4 is held by the opening-and-closing cover 10 to be movable in a specified range in a left-and-right direction (an opening-and-closing direction of the opening-and-closing cover 10) in FIG. 5. As illustrated in FIG. 6, the pressure roller 4 protrudes by a specified amount from a cover-side guide 9 serving as a surrounding member when the opening-and-closing cover 10 is opened. When the opening-and-closing cover 10 is closed and the pressure roller 4 contacts the conveying roller 3, the pressure roller 4 compresses the compression spring 7, moves from the position indicated by the solid line to the position indicated by the broken line in FIG. 6, and presses the conveying roller 3 by the biasing force of the compression spring 7.

The opening-and-closing cover 10 includes a hook 1 that holds the opening-and-closing cover 10 at a closed position. As described later, the hook 1 has a tip slope 1*a* inclined downward from the tip so that the opening-and-closing cover 10 can be closed without operating the handle 20.

As illustrated in FIG. 5, the hook 1 is hooked to an engagement shaft 2 serving as an engaging member disposed on a sheet feeding frame 110*b*, so that the opening-and-closing cover 10 is held at the closed position. The above-described handle 20 is operated to rotate the hook 1 clockwise in FIG. 5 and is disengaged from the engagement shaft 2, so that the opening-and-closing cover 10 can be opened. As illustrated in FIG. 6, the opening-and-closing cover 10 is opened to expose a sheet-feeding conveyance path, and a sheet 102 jammed in the sheet-feeding conveyance path can be easily removed.

Figure 7:
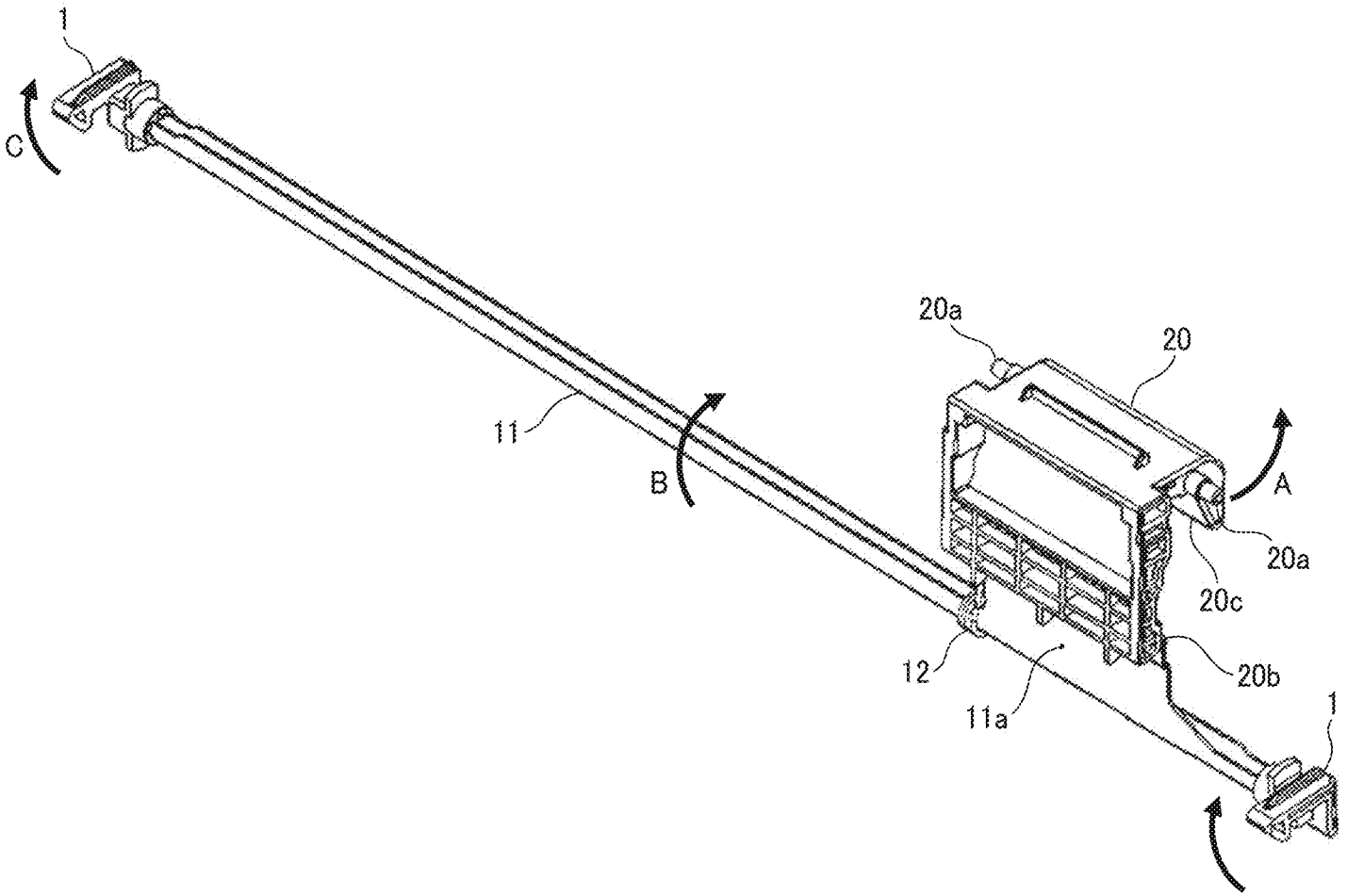
FIG. 7 is a perspective view of a mechanism of releasing the engagement between a hook and an engagement shaft.
Figure 8:
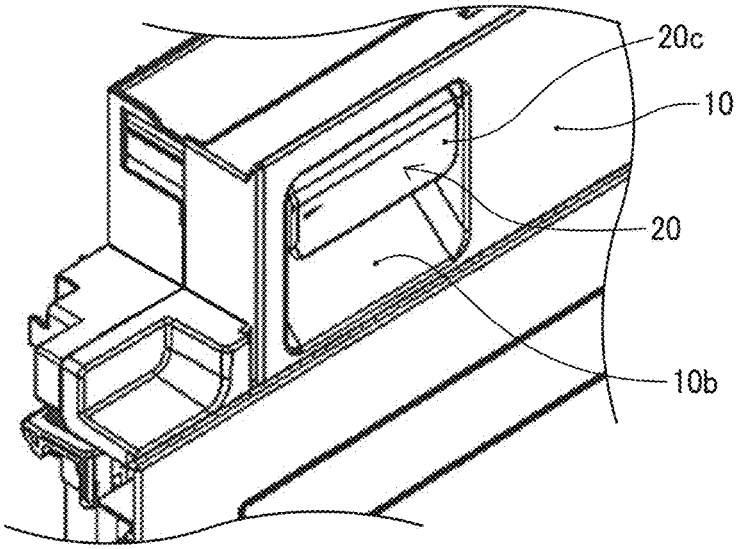
FIG. 8 is a perspective view of a handle of an opening-and-closing cover and components around the handle.

FIG. 7 is a schematic view of a mechanism for releasing the engagement between the hook 1 and the engagement shaft 2 by the operation of the handle 20. FIG. 8 is a perspective view of the handle 20 of the opening-and-closing cover 10 and components around the handle 20. As illustrated in FIG. 7, the hooks 1 are disposed at both ends of a holder 11 extending in the axial direction of the pressure roller 4 (in the front-and-rear direction of the apparatus). The holder 11 is supported to be rotatable in the opening-and-closing cover 10. The holder 11 has a pressed portion 11*a* that is pressed by a pressing portion 20*b* of the handle 20. An upper portion of the pressed portion 11*a* faces the pressing portion 20*b* of the handle 20. The holder 11 is biased by a torsion spring 12 as a biasing member to rotate in a direction opposite to the rotation direction in which the hook 1 and the engagement shaft 2 are disengaged from each other. The pressed portion 11*a* contacts the pressing portion 20*b* of the handle 20 by the biasing force of the torsion spring 12.

The handle 20 includes an operation portion 20*c* having a hook shape, a support shaft 20*a* rotatably supported by the opening-and-closing cover 10, and the pressing portion 20*b* described above. The operation portion 20*c* is exposed from a concave portion 10*b* of the opening-and-closing cover 10 as illustrated in FIG. 8.

When an operator inserts his/her finger into the operation portion 20*c* of the handle 20 from the concave portion 10*b* of the opening-and-closing cover 10 illustrated in FIG. 8 and pushes the operation portion 20*c* toward the front side, the handle 20 rotates in the direction indicated by the arrow A in FIG. 7 around the support shaft 20*a* as a fulcrum. When the handle 20 is rotated in the direction of the arrow A in FIG. 7, the pressing portion 20*b* of the handle 20 pushes the pressed portion 11*a* of the holder 11 against the biasing force of the torsion spring 12. With such a configuration, the holder 11 is rotated in the direction indicated by the arrow B in FIG. 8, and the hooks 1 disposed at both ends of the holder 11 are rotated in the direction indicated by the arrow C in FIG. 7.

Figure 9A:
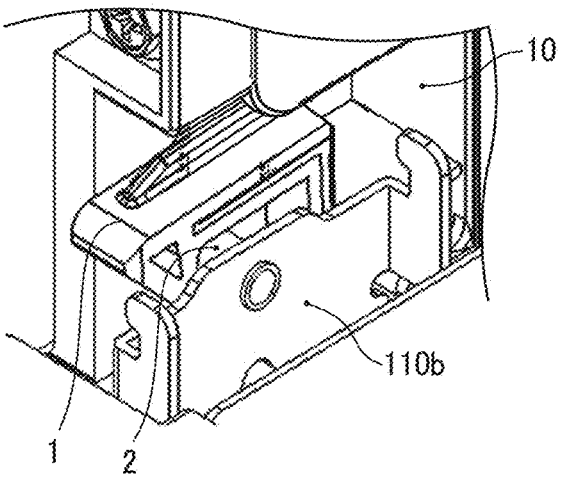
FIGS. 9A and 9B are diagrams illustrating the release of the engagement between the hook and the engagement shaft of FIG. 7.
Figure 9B:
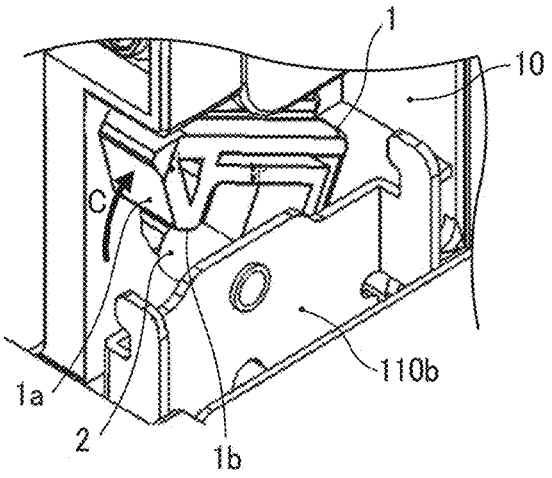

FIGS. 9A and 9B are diagrams illustrating the release of the engagement between the hook 1 and the engagement shaft 2. As illustrated in FIG. 9A, when the opening-and-closing cover 10 is closed, the hook 1 is hooked to the engagement shaft 2 disposed on the sheet feeding frame 110*b*, and the opening-and-closing cover 10 is held at the closed position.

As described with reference to FIG. 7, when an operator operates the operation portion 20*c* of the handle 20 to rotate the hook 1 in the direction indicated by the arrow C in FIG. 7, the lower end 1*b* of the hook 1, which is the lower end of the tip slope 1*a* of the hook 1, is positioned above the top of the engagement shaft 2, as illustrated in FIG. 9B. Such a configuration releases the engagement between the hook 1 and the engagement shaft 2 and enables the opening-and-closing cover 10 to be opened.

Figure 10A:
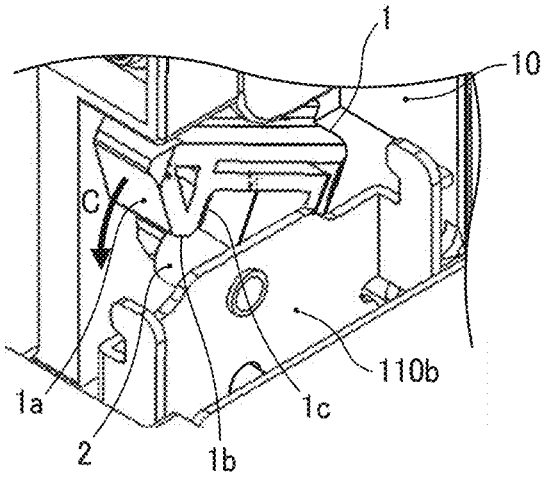
FIGS. 10A and 10B are diagrams illustrating the engagement between the hook and the engagement shaft of FIG. 7.
Figure 10B:
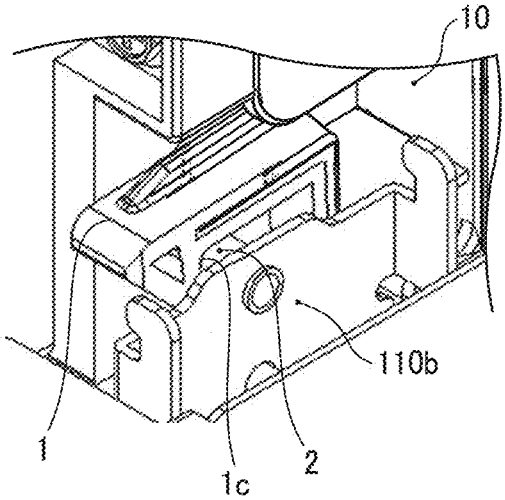

FIGS. 10A and 10B are diagrams illustrating the engagement between the hook 1 and the engagement shaft 2. When an operator pushes the opening-and-closing cover 10 toward the apparatus body from the state in which the opening-and-closing cover 10 is opened to close the opening-and-closing cover 10, the tip slope 1*a* of the hook 1 contacts the engagement shaft 2. When the opening-and-closing cover 10 is further closed from this state, the tip slope 1*a* of the hook 1 is pushed to the engagement shaft 2, and the hook 1 rotates clockwise in FIGS. 10A and 10B against the biasing force of the torsion spring 12. As a result, the engagement shaft 2 relatively moves downward along the tip slope 1*a* of the hook 1.

When the engagement shaft 2 moves relatively to the lower end of the tip slope 1*a* of the hook 1 and the opening-and-closing cover 10 is further closed from that state, the lower end 1*b* of the hook 1 slides up the outer circumferential surface of the engagement shaft 2. When the lower end 1*b* of the hook 1 rides over the top of the engagement shaft 2, as illustrated in FIG. 10A, the hook 1 is rotated in the direction indicated by the arrow C in FIG. 10A by the biasing force of the torsion spring 12, and the lower end 1*b* of the hook 1 slides downward along the outer circumferential surface of the engagement shaft 2. As illustrated in FIG. 10B, the hook 1 engages with the engagement shaft 2, and the opening-and-closing cover 10 is closed.

In the present embodiment, when the lower end 1*b* of the hook 1 rides over the top of the engagement shaft 2, the opening-and-closing cover is automatically closed by the biasing force of the torsion spring 12. Such a configuration can close the opening-and-closing cover 10, even if an operator misunderstands that the opening-and-closing cover 10 has been closed and releases his/her hand from the opening-and-closing cover 10 before the opening-and-closing cover 10 is completely closed.

When an operator releases his/her hand from the opening-and-closing cover 10 before the lower end 1*b* of the hook 1 rides over the top of the engagement shaft 2, the opening-and-closing cover 10 is rotated in the opening direction because the opening-and-closing cover 10 is strongly opened by its own weight. However, if an operator releases his/her hand from the opening-and-closing cover 10 immediately after the lower end 1*b* of the hook 1 has ridden over the top of the engagement shaft 2, the opening-and-closing cover 10 remains at that position, and a half-closed state of the opening-and-closing cover 10 may occur. In such a case where the opening-and-closing cover 10 is in the half-closed state, an operator may misunderstand that the opening-and-closing cover is closed, and the sheet feeding may be started in the half-closed state. In such a half-closed state, the sheet fed from the sheet feed tray cannot be conveyed correctly, and a sheet jam may occur.

Figure 11:
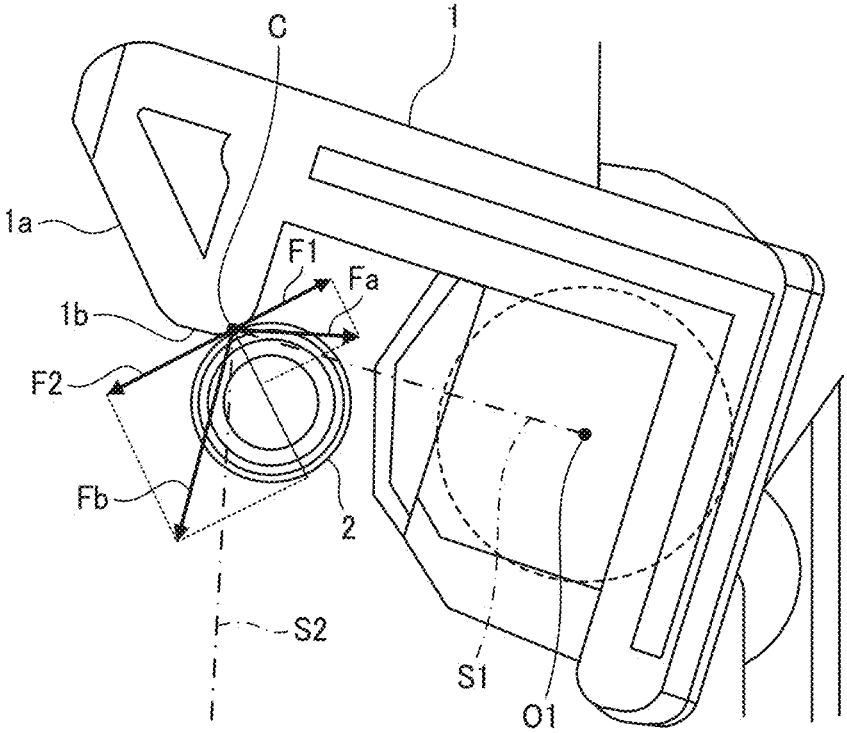
FIG. 11 is a diagram illustrating the relation of forces acting on a contact portion between an engagement shaft and a lower end of a hook when an opening-and-closing cover is closed.

FIG. 11 is a diagram illustrating the relation of forces acting on a contact portion C between the engagement shaft 2 and the lower end 1*b* of the hook 1 when the opening-and-closing cover 10 is closed. As illustrated in FIG. 11, a biasing force Fb of the torsion spring and a force in a direction of opening the opening-and-closing cover 10 (hereinafter referred to as an opening force Fa) due to the own weight of the opening-and-closing cover 10 are applied to the contact portion C between the hook 1 and the engagement shaft 2. The biasing force Fb acts in a direction orthogonal to a line segment S1 connecting a rotation center O1 of the hook 1 and the contact portion C. The opening force Fa acts in a direction orthogonal to a line segment S2 connecting the fulcrum of the rotation (the center of the support shaft 10*a*) of the opening-and-closing cover 10 and the contact portion C.

After the lower end 1*b* of the hook 1 has ridden over the top of the engagement shaft 2, the vector component of the biasing force Fb in the direction of the tangent to the contact portion C becomes the closing force F2 which causes the lower end 1*b* of the hook 1 to slide downward along the outer circumferential surface of the engagement shaft 2. The vector component of the opening force Fa in the tangent direction of the contact portion C becomes the opening force F1 which causes the lower end 1*b* of the hook 1 to slide up the top of the engagement shaft 2.

As the contact portion C is shifted from the position illustrated in FIG. 11 to the left (toward the apparatus body), the angle between the tangent line of the contact portion C and the biasing force Fb becomes smaller, and the closing force F2 becomes greater. On the other hand, as the contact point C is shifted to the left from the position illustrated in FIG. 11, the angle between the tangent line of the contact portion C and the opening force Fa becomes greater. As the contact portion C is shifted to the left from the position illustrated in FIG. 11, the angle between the direction (the vertical direction) of the own weight of the opening-and-closing cover 10 and the line segment S2 becomes smaller. As a result, the opening force Fa, which is a vector component of the own weight of the opening-and-closing cover 10 in the direction perpendicular to the line segment S2, also becomes smaller. Accordingly, the opening force F1 becomes smaller. As a result, as the contact portion C approaches the apparatus body, the closing force F2 by the biasing force Fb of the torsion spring 12 becomes dominant, and the opening-and-closing cover 10 is automatically closed.

On the other hand, as the contact portion C is shifted from the position illustrated in FIG. 11 to the right (the opening side of the opening-and-closing cover 10), the angle between the tangent line of the contact portion C and the biasing force Fb becomes greater, and the closing force F2 becomes smaller. On the other hand, as the contact portion C is shifted to the right from the position illustrated in FIG. 11, the angle between the tangent line of the contact portion C and the opening force Fa becomes smaller. As the contact portion C is shifted to the right from the position illustrated FIG. 11, the angle between the direction (the vertical direction) of the own weight of the opening-and-closing cover 10 and the line segment S2 becomes larger, and the opening force Fa becomes greater. As a result, as the contact portion C moves toward the opening side of the opening-and-closing cover 10, the opening force Fa due to the own weight of the opening-and-closing cover 10 becomes dominant, and the opening-and-closing cover 10 is automatically opened.

A holding force F3 of holding the lower end 1*b* of the hook 1 at the position, such as a friction force between the lower end 1*b* of the hook 1 and the engagement shaft 2, also acts on the contact portion C. While the lower end 1*b* of the hook 1 rides over the top of the engagement shaft 2 and moves by a specified angle, the absolute value of the difference between the closing force F2 and the opening force F1 is small and may be smaller than the holding force F3. As a result, the lower end of the hook 1 does not move on the outer circumference of the engagement shaft 2 and remains at the position, and the opening-and-closing cover 10 becomes a half-closed state.

In the present embodiment, the protrusion amount of the pressure roller 4 from the cover-side guide 9 is adjustable, and the absolute value of the difference between the closing force F2 and the opening force F1 is prevented from falling below the holding force F3 due to the reaction force from the conveying roller 3 when the pressure roller 4 contacts the conveying roller 3.

Figure 12:
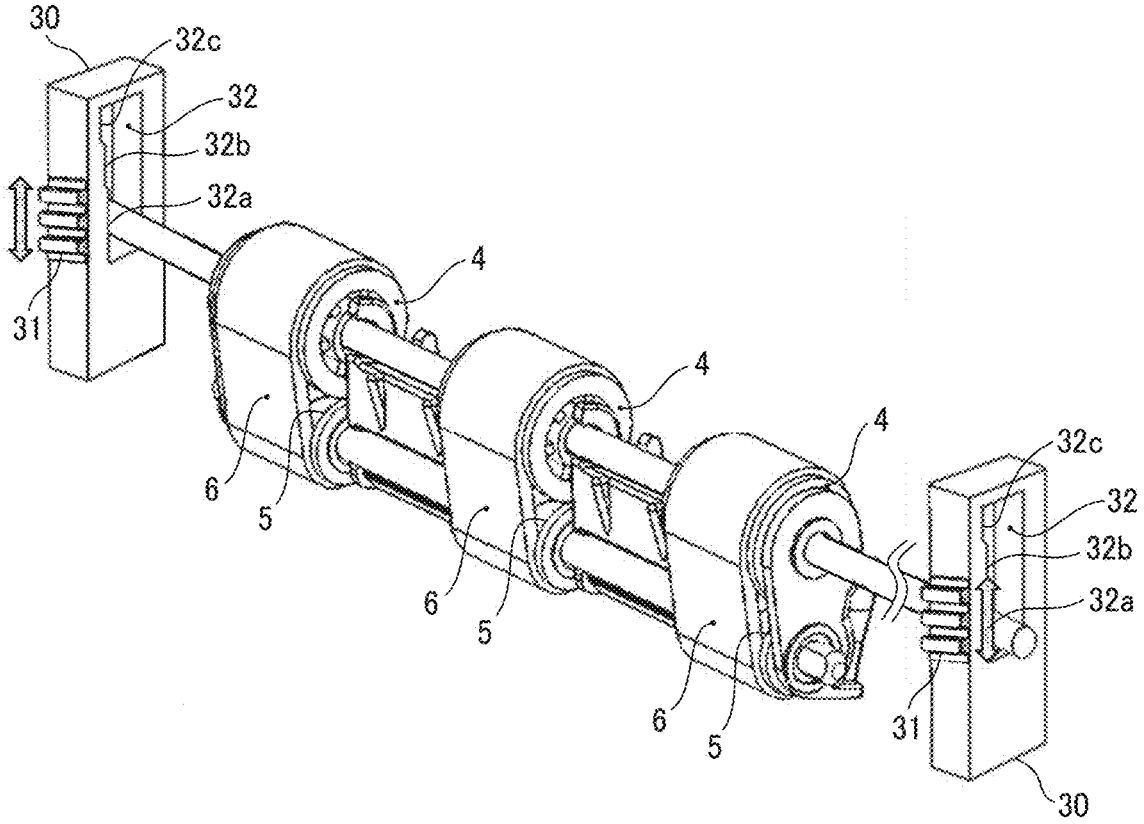
FIG. 12 is a schematic view of an adjuster.

FIG. 12 is a schematic view of adjusters 30 of adjusting the protrusion amount of the pressure roller 4 from the cover-side guide 9. As illustrated in FIG. 12, the adjusters 30 are disposed at both ends of a shaft 4*a* of the pressure roller 4. Each of the adjusters 30 has a through hole 32. The through hole 32 is long in the up-and-down direction. The shaft 4*a* of the pressure roller 4 passes through the through hole 32. The surface of the through hole 32 on the apparatus body side has three stepped surfaces 32*a*, 32*b*, and 32*c*. Each of the adjusters 30 is held to be movable in the up-and-down direction by the opening-and-closing cover 10 within a specified range. Each of the adjusters 30 has a knob 31 having a concave-and-convex shape. An operator touches the knob 31 with his/her fingers when the operator operates the adjuster 30. The knob 31 has a concave-and-convex shape so that an operator's finger can slide the adjuster 30 in the up-and-down direction without slipping against the adjuster 30.

Figure 13A:
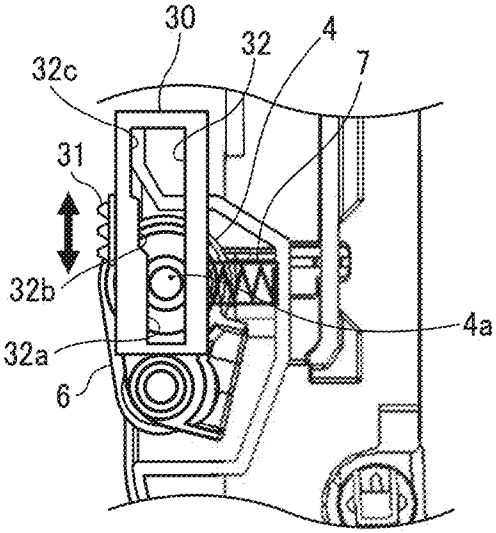
FIGS. 13A, 13B, and 13C are diagrams illustrating the adjustment of a protrusion amount of a pressure roller by an adjuster.
Figure 13B:
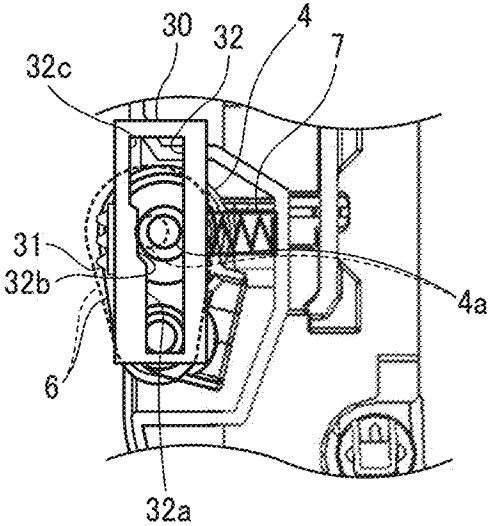
Figure 13C:
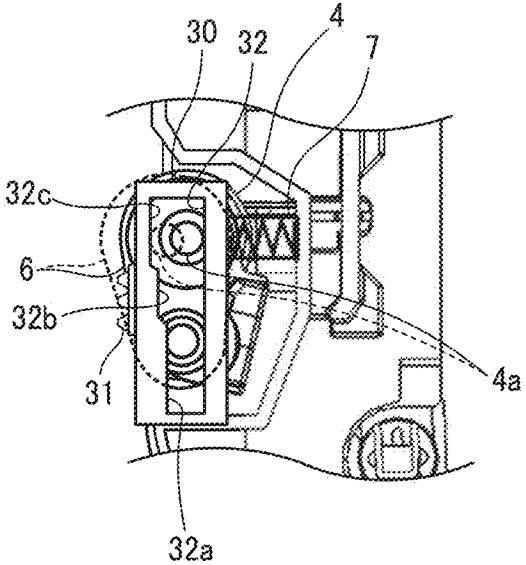

FIGS. 13A, 13B, and 13C are diagrams illustrating the adjustment of a protrusion amount of the pressure roller 4 from the cover-side guide 9 by the adjuster 30. As illustrated in FIG. 13A, at the initial time, the adjuster 30 is positioned at the uppermost position in the moving range in the up-and-down direction, and at this time, the shaft 4*a* of the pressure roller 4 contacts the lowermost stepped surface 32*a* of the three stepped surfaces 32*b*, 32*a* and 32*c*. The clearance in the left-and-right direction (the opening-and-closing direction of the opening-and-closing cover 10) in FIG. 13A at the position of the lowermost stepped surface 32*a* of the through hole 32 is larger than the diameter of the shaft 4*a* of the pressure roller 4. Accordingly, even when the shaft 4*a* of the pressure roller 4 contacts the lowermost stepped surface 32*a*, the shaft 4*a* is movable in the through hole 32 within a specified range in the left-and-right direction in FIG. 13A.

As illustrated in FIG. 13A, at the initial time, the shaft 4*a* of the pressure roller 4 contacts the lowermost stepped surface 32*a*, so that the protrusion amount of the pressure roller 4 from the cover-side guide 9 is small. As described above, the opening-and-closing cover 10 is rotated around the support shaft 10*a* at the lower end as a fulcrum. When the opening-and-closing cover 10 is closed, the pressure roller 4 moves obliquely upward while drawing an arc-shaped locus. When the protrusion amount of the pressure roller 4 from the cover-side guide 9 is large, the pressure roller 4 may contact the conveying roller 3 from obliquely below, and a conveyance nip may not be formed at a desired position.

On the other hand, as illustrated in FIG. 13A, the protrusion amount of the pressure roller 4 from the cover-side guide 9 is lessened as much as possible, so that the pressure roller 4 can be contacted against the conveying roller 3 as immediately as possible before the opening-and-closing cover 10 is closed. Such a configuration can contact the pressure roller 4 against the conveying roller 3 from a substantially horizontal direction and form a conveyance nip at a target position with high accuracy. Accordingly, in the case where the half-closed state of the opening-and-closing cover 10 does not occur, the adjuster 30 is positioned so that the shaft 4*a* of the pressure roller 4 illustrated in FIG. 13A contacts the lowermost stepped surface 32*a*.

When the operator operates the knob 31 to lower the adjuster 30 and cause the shaft 4*a* of the pressure roller 4 to contact the stepped surface 32*b* at the center in the up-and-down direction as illustrated in FIG. 13B, the protrusion amount of the pressure roller 4 from the cover-side guide 9 increases. As a result, the pressure roller 4 contacts the conveying roller 3 at an earlier stage than in the case of FIG. 13A, and the opening-and-closing cover 10 receives a reaction force from the conveying roller 3 in the opening direction at an earlier stage than in the case of FIG. 13A.

When the operator operates the knob 31 to further lower the adjuster 30 and cause the shaft 4*a* of the pressure roller 4 to contact the uppermost stepped surface 32*c* as illustrated in FIG. 13C, the protrusion amount of the pressure roller 4 from the cover-side guide 9 is maximum. As a result, the pressure roller 4 contacts the conveying roller 3 at an earlier stage than in the case of FIG. 13B, and the opening-and-closing cover receives a reaction force from the conveying roller 3 in the opening direction at an earlier stage than in the case of FIG. 13B.

The protrusion amount of the pressure roller 4 from the cover-side guide 9 when the opening-and-closing cover 10 is closed is the same in any of the cases of FIGS. 13A, 13B, and 13C, and the compression amount of the compression spring 7 is the same. Accordingly, the contact pressure of the pressure roller 4 against the conveying roller 3 when the opening-and-closing cover 10 is closed is constant, and the conveyance nip pressure can be optimized for conveying the sheet.

Figure 14B:
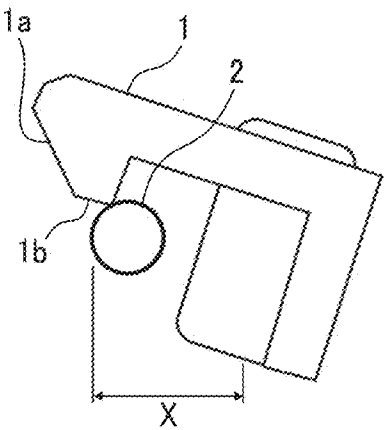
FIG. 14B is a diagram illustrating a positional relation between a hook and an engagement shaft.
Figure 14A:
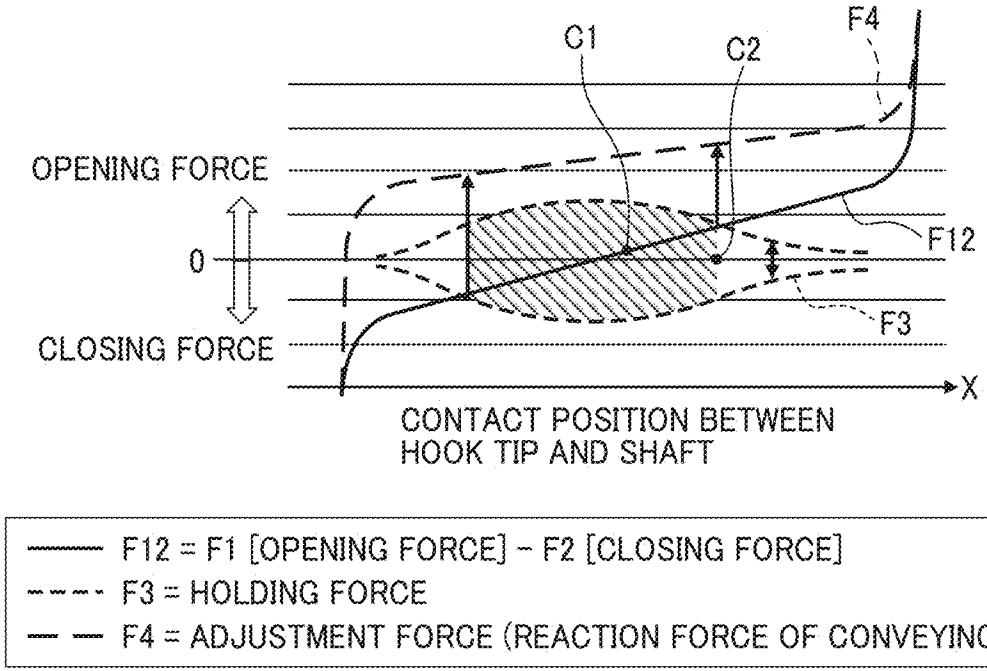
FIG. 14A is a graph illustrating a relation between an adjustment force F4 acting on a contact portion between an engagement shaft and a lower end of a hook, a difference value F12 between a closing force F2 and an opening force F1, and a holding force F3.

FIG. 14A is a graph illustrating the relation between the tangential force (hereinafter referred to as adjustment force F4) of the reaction force from the conveying roller 3 at the contact portion C between the lower end 1*a* of the hook 1 and the engagement shaft 2, the difference value F12 (=F1-F2) between the closing force F2 and the opening force F1, and the holding force F3. The reaction force from the conveying roller 3 acts on the contact portion C and is received by the opening-and-closing cover 10. The horizontal axis X in FIG. 14A indicates the horizontal position of the contact portion C between the lower end 1*b* of the hook 1 and the engagement shaft 2.

As described above, the opening force F1 decreases as the opening-and-closing cover 10 is closed. However, the closing force F2 increases as the opening-and-closing cover 10 is closed. Accordingly, as illustrated in FIG. 14A, the difference value F12 between the opening force F1 and the closing force F2 gradually decreases as the opening-and-closing cover 10 is closed. The difference value F12 becomes negative in the middle of the process, and the difference value F12 becomes a force in the closing direction (closing force).

The holding force F3 illustrated in FIG. 14A is the maximum value of the holding force F3 at each position. When the difference value F12 is the opening force, the holding force F3 acts as the closing force. When the difference value F12 is the closing force, the holding force F3 acts as the opening force. In the hatched region in FIG. 14A, the difference value F12 may be smaller than the holding force F3. The lower end 1*b* of the hook 1 may not slide on the engagement shaft 2 and may remain at that position, thereby causing the opening-and-closing cover 10 to be in a half-closed state.

The reaction force of the conveying roller 3 acting in the direction of opening the opening-and-closing cover 10 acts in the same direction as the opening force Fa illustrated in FIG. 11 at the contact portion C between the lower end 1*b* of the hook 1 and the engagement shaft 2. As a result, the adjustment force F4, which is a vector component in the tangential direction at the contact portion C of the reaction force of the conveying roller 3 acting on the contact portion C, increases the opening force F1, which is a force in the direction in which the lower end 1*b* of the hook 1 moves up toward the top of the engagement shaft 2.

The reaction force from the conveying roller 3 acting on the contact portion C increases as the opening-and-closing cover 10 is closed (as the contact portion C is positioned on the left, that is, near the apparatus body in FIG. 11). On the other hand, as the opening-and-closing cover 10 is closed, the angle formed by the reaction force acting in the same direction as the opening force Fa illustrated in FIG. 11 and the tangent line of the contact portion C increases at the contact portion C, and the adjustment force F4 acts in a direction of decreasing. In the present embodiment, the decreasing amount of the adjustment force F4 due to the increasing of the angle formed with the tangent line of the contact portion C exceeds the increasing amount of the reaction force. As a result, as illustrated in FIG. 14A, the adjustment force F4 gradually decreases as the opening-and-closing cover 10 is closed. However, as illustrated in FIG. 14A, the adjustment force F4 is greater than the maximum value of the holding force F3 at each position, so that the opening-and-closing cover 10 is opened by the action of the adjustment force F4 without being in the half-closed state.

As illustrated in FIG. 14A, there is a portion where the opening force F1 and the closing force F2 are balanced and the difference value F12 between the opening force F1 and the closing force F2 is zero. At this point, the difference value F12 falls below the holding force F3, and the half-closed state of the opening-and-closing cover 10 occurs. Accordingly, when the pressure roller 4 protrudes from the cover-side guide 9 by the minimum amount as illustrated in FIG. 13A, the pressure roller 4 contacts the conveying roller 3 at the contact portion C1 before the contact portion between the lower end 1*b* of the hook 1 and the engagement shaft 2 where the difference value F12 becomes zero, thereby generating the adjustment force F4.

In the state illustrated in FIG. 13C, the protrusion amount is such that the pressure roller 4 contacts the conveying roller 3 at a stage before the position C2 (see FIG. 14A) at the forefront of the range in which the half-closed state of the opening-and-closing cover 10 occurs. Specifically, the half-closed state of the opening-and-closing cover 10 may occur after the lower end 1*b* of the hook 1 exceeds the top of the engagement shaft 2. Accordingly, the protrusion amount of the pressure roller 4 from the cover-side guide 9 in FIG. 13C is adjusted so that the pressure roller 4 contacts the conveying roller 3 at a stage where the contact portion between the lower end 1*b* of the hook 1 and the engagement shaft 2 is positioned upstream from the top of the engagement shaft 2 in the direction in which the lower end 1*b* of the hook 1 rides over the top of the engagement shaft 2. As a result, as illustrated in FIG. 13C, when the shaft 4*a* of the pressure roller 4 contacts the uppermost stepped surface 32*c* of the adjuster 30, the half-closed state of the opening-and-closing cover 10 can be reliably prevented.

Figure 15A:
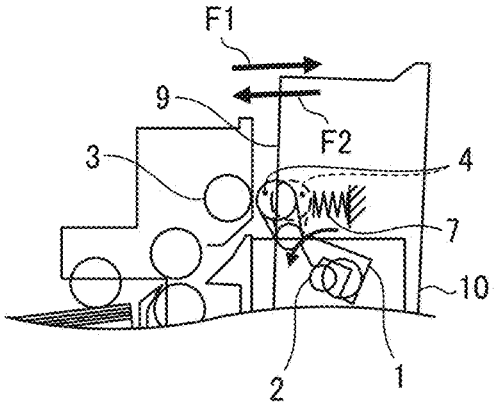
FIGS. 15A and 15B are diagrams illustrating the adjustment of a protrusion amount by an adjuster when a half-closing occurs.
Figure 15B:
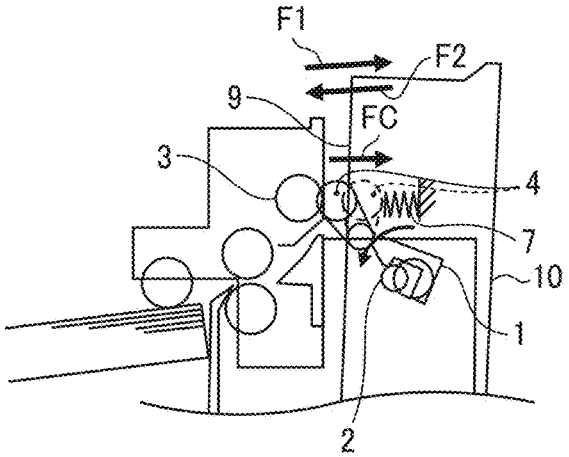

When the half-closed state of the opening-and-closing cover 10 occurs, the adjuster 30 is operated to move the pressure roller 4 from the position indicated by the broken line in FIG. 15A to the position indicated by the solid line in FIG. 15A, so that the protrusion amount of the pressure roller 4 from the cover-side guide 9 is increased. As illustrated in FIG. 15B, such a configuration causes the pressure roller 4 to contact the feeding roller 3 to generate the reaction force Fc in the direction in which the opening-and-closing cover 10 is opened before the lower end 1*b* of the hook 1 reaches the contact portion where the opening-and-closing cover 10 is in the half-closed state. As a result, the adjustment force F4 acts on the contact portion C. As illustrated in FIG. 14A, the adjustment force F4 is greater than the maximum value of the holding force F3. The lower end 1*b* of the hook 1 moves up toward the top of the engagement shaft 2 by the action of the adjustment force 4F, and the opening-and-closing cover 10 is opened. Such a configuration prevents the opening-and-closing cover 10 from being in the half-closed state and causes an operator to be aware that the opening-and-closing cover 10 is not closed. As a result, an operator can push the opening-and-closing cover 10 toward the apparatus body again to close the opening-and-closing cover 10.

In the present embodiment, the side face of the through hole 32 of the adjuster 30, which the shaft 4*a* of the pressure roller 4 contacts, is formed in a stepped shape, and the protrusion amount of the pressure roller 4 from the cover-side guide 9 is switched in a stepwise manner. Such a configuration can easily match the protrusion amount of the pressure roller 4 on one end in the axial direction from the cover-side guide portion 9 with the protrusion amount of the pressure roller 4 on the other end in the axial direction from the cover-side guide 9, so that the protrusion amount can be easily adjusted manually.

The side face of the through hole 32 of the adjuster 30 may be formed as an inclined surface which is closer to the apparatus body as the position in the inclined surface is higher, and the protrusion amount may be linearly adjusted. Such a configuration can finely adjust the protrusion amount, and can reduce the protrusion amount to restrict the half-closed state of the opening-and-closing cover 10 compared to the case where the protrusion amount is switched in a stepwise manner. Reducing the protrusion amount allows the pressure roller 4 to contact the conveying roller 3 as immediately as possible before the opening-and-closing cover 10 is closed, and the conveyance nip can be formed at a target position.

When the position of the adjuster 30 on one end is different in the up-and-down direction from the position of the adjuster 30 on the other end, the timing of generation of the reaction force applied to the contact portion between the lower end 1*b* of the hook 1 on one end in the axial direction and the engagement shaft 2 is different from the timing of generation of the reaction force applied to the contact portion between the lower end 1*b* of the hook 1 on the other end and the engagement shaft 2. As a result, when the opening-and-closing cover 10 is about to be opened only in one end in the axial direction, the opening-and-closing cover 10 may be twisted.

Accordingly, a position detection sensor that detects the position of the adjuster 30 in the up-and-down direction may be disposed. When the position of the adjuster 30 on one end in the axial direction and the position of the adjuster 30 on the other end in the axial direction are different in the up-and-down direction from each other, an operator may be notified of the detection result.

A distance sensor can be used as the position detection sensor that detects the positions. The distance sensor is disposed to face the adjuster 30 from above or below and measure the distance from the adjuster 30. Thus, the position of the adjuster 30 in the up-and-down direction can be detected.

Figure 16:
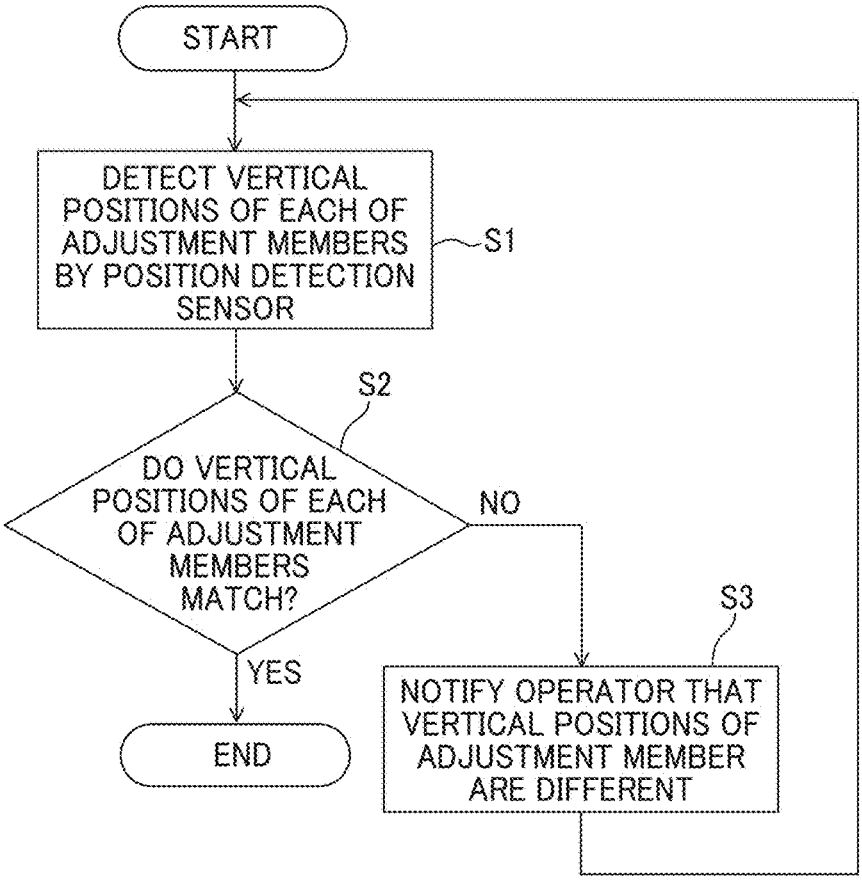
FIG. 16 is a flowchart of position adjustment control of an adjuster.

FIG. 16 is a flowchart of position adjustment control of the adjuster 30. For example, when a controller of the image forming apparatus 101 detects that the opening-and-closing cover 10 is opened, the controller periodically detects the positions of the adjusters 30 in the up-and-down direction by the position detection sensors (in step S1 in FIG. 16). When the positions of the adjusters 30 in the up-and-down direction coincide with each other (Yes in step S2 in FIG. 16), the control is ended as it is.

On the other hand, when a state in which the positions of the adjuster 30 in the up-and-down direction do not match continues for a specified time, the control panel 130 displays that the position of the adjuster 30 in the up-and-down direction on one end in the axial direction and the position of the adjuster 30 in the up-and-down direction on the other end in the axial direction are different from each other (in step S3 in FIG. 16). At this time, the position of the adjuster 30 in the up-and-down direction on one end in the axial direction and the position of the adjuster 30 in the up-and-down direction on the other end in the axial direction are preferably displayed on the control panel 130. When the positions of the adjusters 30 are displayed, an operator can be informed how much the operator should adjust any one of the two adjusters 30 in the up-and-down direction to match the positions of the adjusters 30 in the up-and-down direction.

When the positions of the adjusters 30 in the up-and-down direction do not coincide with each other, an operator is notified of the detection result. Thus, the opening-and-closing cover 10 can be prevented from being closed in a state where the protrusion amount of the pressure roller 4 from the cover-side guide 9 is different between one end and the other end in the axial direction from each other. As a result, the occurrence of twisting in the opening-and-closing cover 10 can be reduced when the opening-and-closing cover 10 is opened and closed.

Figure 17:
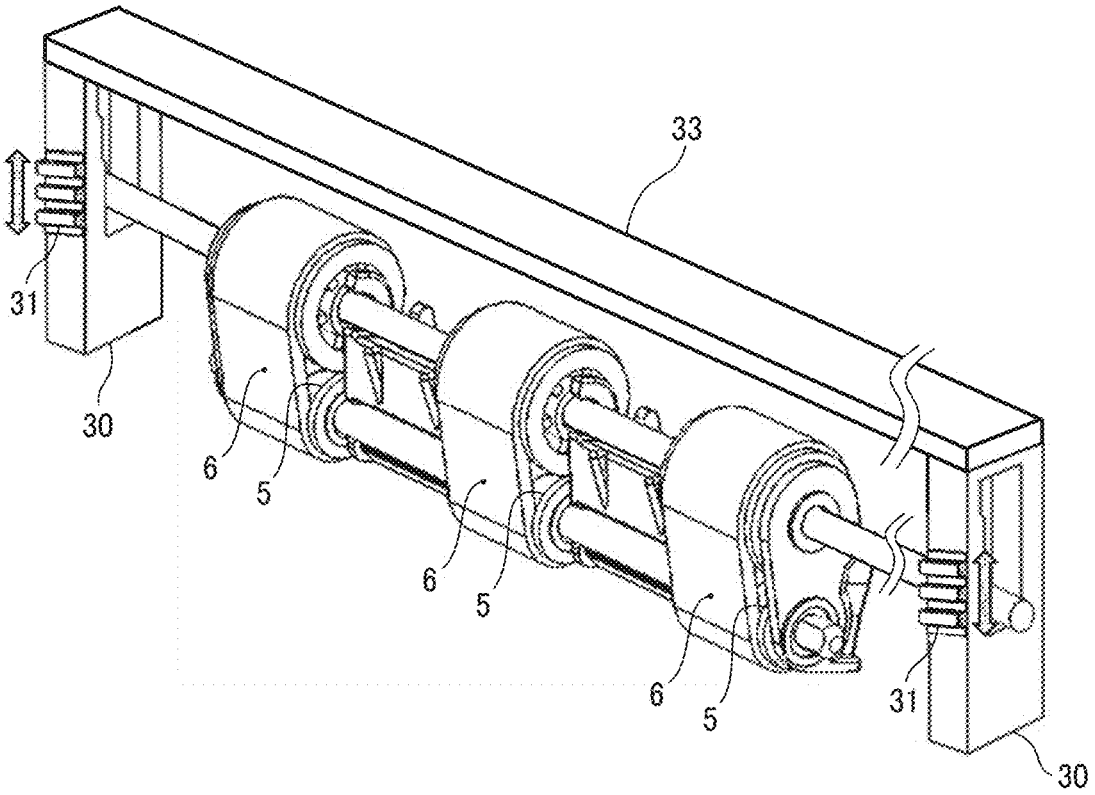
FIG. 17 is a perspective view of a configuration in which an adjuster on one end and an adjuster on the other end in the axial direction are connected by a connector.

FIG. 17 is a perspective view of a configuration in which the adjuster 30 on one end and the adjuster 30 on the other end in the axial direction are connected by a connector 33. As illustrated in FIG. 17, the adjuster 30 on one end in the axial direction and the adjuster 30 on the other end in the axial direction are connected by the connector 33. Thus, the adjuster 30 on one end in the axial direction and the adjuster 30 on the other end in the axial direction can be moved in the up-and-down direction in conjunction with each other. Such a configuration can simplify the operation of adjusting the protrusion amount of the pressure roller 4 as compared to the case where the adjusters 30 are separately moved in the up-and-down direction to adjust the projection amount of the pressure roller 4. Such a configuration can prevent the position of the adjuster 30 on one end in the axial direction and the position of the adjuster 30 on the other end in the axial direction from being different from each other in the up-and-down direction and can prevent the protrusion amount of the pressure roller 4 on one end in the axial direction and the protrusion amount of the pressure roller 4 on the other end from being different from each other.

Figure 18:
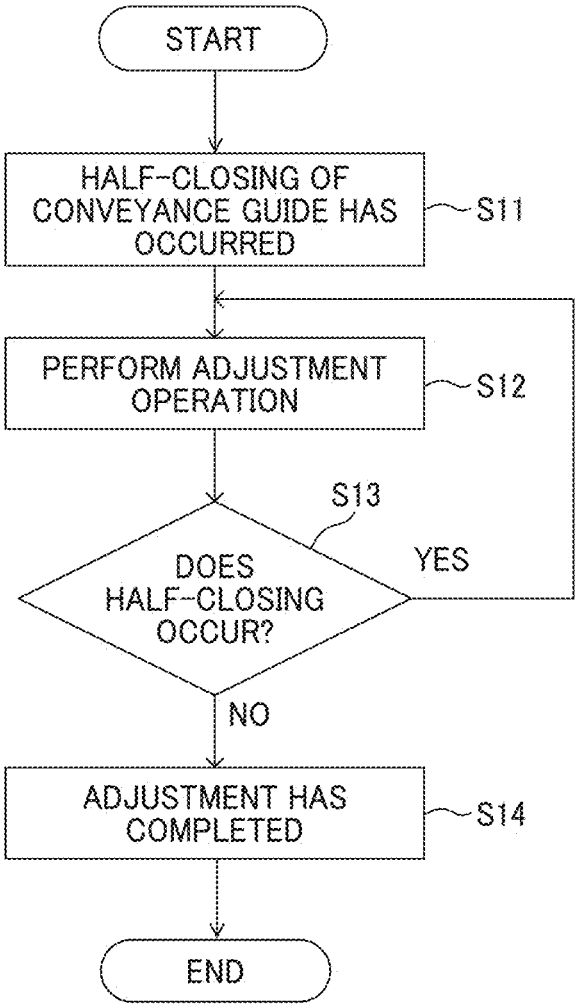
FIG. 18 is a flowchart of an adjustment operation of moving an adjuster in an up-and-down direction by a driver.

In the configuration described above, the adjuster 30 is manually moved in the up-and-down direction. However, a driver may be disposed to move the adjuster 30 in the up-and-down direction. FIG. 18 is a flowchart of an adjustment operation of moving the adjuster 30 in the up-and-down direction by the driver. When an operator confirms that the opening-and-closing cover 10 is in the half-closed state (in step S11 in FIG. 18), the operator operates the control panel 130 to instruct the execution of the adjustment operation with the adjuster 30 (in step S12 in FIG. 18). In response to the instruction of the execution of the adjustment operation, the controller drives the driver to lower the adjuster 30 from the state illustrated in FIG. 13A to the state illustrated in FIG. 13B, so that the protrusion amount of the pressure roller 4 from the cover-side guide 9 is changed. In the state illustrated in FIG. 13B, the controller displays a message for confirming whether the opening-and-closing cover 10 is opened on the control panel 130. When an operator operates the control panel 130 to input the confirmation that the opening-and-closing cover 10 is opened, the adjustment operation is ended (in step S14 in FIG. 18).

On the other hand, when the opening-and-closing cover 10 is not opened and remains in the half-closed state of the opening-and-closing cover 10 even after the state is changed to the state illustrated in FIG. 13B (Yes in step S13 in FIG. 18), an operator operates the control panel 130 to input that the opening-and-closing cover 10 is in the half-closed state. When the controller receives an input that the opening-and-closing cover 10 is in the half-closed state, the controller drives the driver again to lower the adjuster 30 again and changes from the state illustrated in FIG. 13B to the state illustrated in FIG. 13C. As described above, in the state of FIG. 13C, the pressure roller 4 contacts against the conveying roller 3 at a stage before the region where the half-closed state of the opening-and-closing cover 10 occurs (the hatched region in FIG. 14A). As a result, the reaction force of the conveying roller 3 is generated, so that the opening-and-closing cover 10 in the half-closed state is opened. As a result, the occurrence of half-closing state can be prevented when the opening-and-closing cover 10 is closed.

The above-described embodiments are illustrative and do not limit the present disclosure. Thus, numerous additional modifications and variations are possible in light of the above teachings. For example, elements and/or features of different illustrative embodiments may be combined with each other and/or substituted for each other within the scope of the present disclosure.

For example, in the above description, the opening-and-closing cover for opening and closing the conveyance path of the sheet feeder 110 is applied to a sheet conveying device according to the present disclosure. However, the present disclosure may be applied to an opening-and-closing cover for opening and closing the duplex sheet conveyance path 120.

In the above description, the protrusion amount of the pressure roller 4 is adjusted to reduce the occurrence of the half-closed state of the opening-and-closing cover 10. However, a pressing member that contacts a member of the apparatus body to press the member of the apparatus body may also be disposed separately from the pressure roller 4, and the protrusion amount of the pressing member may also be adjusted. The pressing member may be contacted with a member of the apparatus body before reaching the region in which the half-closed state of the opening-and-closing cover 10 occurs, indicated by the hatched region in FIG. 14A. The biasing force of the biasing member such as a spring applied to the pressing member may be adjusted to adjust the pressing force applied to the member of the apparatus body. In this case, the reaction force from a member of the apparatus body increases by the adjustment of the pressing force, so that the force in the opening direction increases and the occurrence of the half-closed state of the opening-and-closing cover 10 can be reduced.

The above-described embodiments are given as examples, and, for example, the following aspects of the present disclosure may have advantageous effects described below.

First Aspect

The sheet conveying device includes an opening-and-closing member (e.g., the opening-and-closing cover 10), a pressing member (e.g., the pressure roller 4), a hook (e.g., the hook 1), a biasing member (e.g., the torsion spring 12), and an adjuster (e.g., the adjuster 30). A lower end of the opening-and-closing member is rotatably supported by an apparatus body. The opening-and-closing member opens and closes a sheet conveyance path. The pressing member is disposed in the opening-and-closing member and presses a pressed member (e.g., the conveying roller 3) of the apparatus body. The hook engages with an engaging member (e.g., the engagement shaft 2) of the apparatus body and holds the opening-and-closing member at a closing position. The biasing member biases the hook such that the engagement of the hook with the engaging member is maintained. The hook rotates against a biasing force of the biasing member while sliding on the engaging member such that the hook rides over the engaging member and engages with the engaging member. The adjuster adjusts at least one of a pressing force of the pressing member and a protrusion amount of the pressing member with respect to a surrounding member (e.g., the cover-side guide 9). The hook and the engaging member are configured as follows. In other words, the engaging member is a shaft. The hook is supported to be rotatable with respect to the opening-and-closing member and is biased by the biasing member so that the engagement of the hook with the engaging member is maintained. The hook has a tip slope (e.g., the tip slope 1*a*) that is inclined to be lower in a direction away from a tip of the hook. With such a configuration, as to be described below, the hook rotates against the biasing force of the biasing member while sliding on the engaging member and rides over the engaging member to engage with the engaging member. Specifically, when the opening-and-closing member is rotated around the lower end as a fulcrum to close, the tip slope of the hook contacts the engaging member. When the opening-and-closing member is further closed from this state, the hook rotates in the direction in which the tip moves upward against the biasing force of the biasing member. The engaging member relatively moves downward from the tip slope along the tip slope of the hook. After the engaging member has reached the lower end of the tip slope, the lower end of the tip slope slides on the outer circumferential surface of the circumferential engaging member to move upward. When the lower end of the tip slope has passed through the top of the engaging member, the tip of the hook is rotated in a direction in which the tip of the hook moves downward by the biasing force of the biasing member, and the lower end of the tip slope slides downward along the outer circumferential surface of the engaging member. The hook engages with the engaging member, so that the opening-and-closing member is closed. In this way, when the lower end of the tip slope rides over the top of the engaging member, the opening-and-closing member is automatically closed by the biasing force of the biasing member. When the opening-and-closing member is closed, as illustrated in FIG. 11, the own weight of the opening-and-closing member is applied to the contact portion C between the hook (the lower end of the tip slope) and the engaging member as a force in a direction in which the opening-and-closing member is opened (hereinafter, referred to as an opening force Fa). After the opening-and-closing member has passed the top of the engaging member, the vector component of the opening force Fa in the tangent direction of the contact portion becomes a force (hereinafter, referred to as opening force F1) in a direction in which the contact portion (lower end of the tip slope) between the hook and the engaging member is moved toward the top of the engaging member. Depending on the relation between the opening force F1 and the tangential vector component (hereinafter referred to as a closing force F2) at the contact portion of the biasing force Fb of the biasing member for moving the contact portion of the hook with the engaging member downward along the outer circumferential surface of the engaging member, the relation of forces between the opening force F1 and the closing force F2 may be smaller than the force (hereinafter referred to as a holding force F3), such as sliding resistance between the hook and the outer circumferential surface of the engaging member at the contact portion between the hook and the engaging member, for stopping the movement of the contact portion. As a result, the sliding of the hook with the engaging member may stop halfway, and the half-closed state of the opening-and-closing member may occur. In the first aspect, the adjuster adjusts at least one of a pressing force of the pressing member and a protrusion amount of the pressing member with respect to a surrounding member. Thus, the reaction force from the pressed member of the apparatus body when the contact portion (the lower end of the tip slope) of the hook with the engaging member passes through the top of the engaging member and moves downward along the outer circumferential surface and the timing at which the reaction force is generated can be adjusted. The reaction force acts as the opening force Fa at the contact portion C to increase the opening force F1. Increasing the opening force F1 can prevent the relation of forces between the opening force F1 and the closing force F2 from becoming the relation of forces in which the sliding of the hook 1 with the outer circumferential surface of the engaging member stops halfway (difference between the opening force F1 and the closing force F2 is less than the holding force F3). Such a configuration can reduce the occurrence of the half-closed state of the opening-and-closing member.

Second Aspect

In the sheet conveying device according to the first aspect, the engaging member (e.g., the engagement shaft 2) is a shaft, and the tip of the hook (e.g., the hook 1) is inclined with respect to the vertical direction. With such a configuration, as described in the embodiment, the hook rotates against the biasing force of the biasing member (e.g., the torsion spring 12) while sliding on the engaging member, so that the hook rides over the engaging member and engages with the engaging member.

Third Aspect

In the sheet conveying device according to the first or second aspect, the adjuster (e.g., the adjuster 30) adjusts the protrusion amount of the pressing member (e.g., the pressure roller 4). When an engaging operation in which the hook (e.g., the hook 1) rides over the engaging member (e.g., the engagement shaft 2) and engages with the engaging member while sliding on the engaging member is performed, the adjuster can adjust the protrusion amount of the pressing member such that the pressing member contacts the pressed member (e.g., the conveying roller 3) before the contact portion (e.g., the lower end 1*b*) of the hook with the engaging member reaches the top of the engaging member. With such a configuration, as described in the embodiment, the contact portion of the hook does not slide on the engaging member and stops due to the relation of forces between the opening force F1 and the closing force F2 after the contact portion rides over the top of the engaging member in the vertical direction. Accordingly, the adjuster adjusts the protrusion amount of the pressing member, and the pressing member contacts the pressed member before the engaging member is positioned at the top in the vertical direction. Thus, the reaction force can be generated before the lower end of the hook rides over the top of the engaging member in the vertical direction. Such a configuration can reliably prevent the occurrence of the half-closed state of the opening-and-closing member.

Fourth Aspect

In the sheet conveying device according to any one of the first to third aspects, the pressed member is a conveying roller (e.g., the conveying roller 3), the pressing member is a pressure roller (e.g., the pressure roller 4), the surrounding member is a guide (e.g., the cover-side guide 9) that guides a sheet such as a paper sheet, and the adjuster (e.g., the adjuster 30) adjusts the protrusion amount of the pressing member with respect to the guide. According to this configuration, as described in the embodiment, the protrusion amount of the pressing member with respect to the guide is adjusted. Thus, the occurrence of the half-closed state of the opening-and-closing member (e.g., the opening-and-closing cover 10) can be reduced without changing the pressing force of the pressing member applied to the pressed member when the opening-and-closing member is closed.

Fifth Aspect

In the sheet conveying device according to any one of the first to fourth aspects, the adjuster (e.g., the adjuster 30) and another adjuster are disposed on one end and the other end, respectively, in the axial direction of the pressing member (e.g., the pressure roller 4) to be movable in a specified range with respect to the opening-and-closing member (e.g., the opening-and-closing cover 10). The adjuster and the other adjuster are moved so that at least one of the pressing force and the protrusion amount is switched in a stepwise manner. Such a configuration can easily make the timing at which the reaction force is generated and the pressing force same between one end and the other end in the axial direction, as compared to the case where at least one of the pressing force and the protrusion amount is linearly changed. Thus, manual adjustment is facilitated.

Sixth Aspect

In the sheet conveying device according to any one of the first to fifth aspects, the adjuster (e.g., the adjuster 30) and another adjuster are disposed on one end and the other end, respectively, of the pressing member (e.g., the pressure roller 4) in the axial direction to be movable in a specified range with respect to the opening-and-closing member (e.g., the opening-and-closing cover 10). The adjuster and the other adjuster are moved so that at least one of the pressing force and the protrusion amount is adjusted. The sheet conveying device includes a notifier (e.g., the control panel 130) that notifies an operator when the position of the adjuster disposed on the one end is different from the position of the other adjuster disposed on the other end. As described in the present embodiment, such a configuration can prevent the position of the adjuster on one end and the position of the adjuster on the other end from being different from each other and can prevent the adjustment amount on the one end and the adjustment amount on the other end from being different from each other. Such a configuration can make the timing of generating the reaction force on one end and the reaction force on the other end in the axial direction substantially the same, can make the pressing force of generating the reaction force on one end and the pressing force on the other end in the axial direction substantially the same, and can reduce the occurrence of the twist of the opening-and-closing member when the opening-and-closing member is opened and closed.

Seventh Aspect

In the sheet conveying device according to any one of the first to fifth aspects, the adjuster (e.g., the adjuster 30) and another adjuster are disposed on one end and the other end, respectively, of the pressing member (e.g., the pressure roller 4) in the axial direction to be movable in a specified range with respect to the opening-and-closing member (e.g., the opening-and-closing cover 10). The adjuster disposed on the one end of the pressing member and the other adjuster disposed on the other end of the pressing member move in conjunction with each other. As described in the embodiment, such a configuration can simplify the adjustment work compared to the case where the adjustment is performed by moving the adjusters in the up-and-down direction separately. Such a configuration can prevent the position of the adjuster on one end and the position of the adjuster on the other end from being different from each other and can prevent the adjustment amount on one end and the adjustment amount on the other end from being different from each other. Such a configuration can make the timing of generating the reaction force on one end and the reaction force on the other end in the axial direction substantially the same, can make the pressing force of generating the reaction force on one end and the pressing force on the other end in the axial direction substantially the same, and can reduce the occurrence of the twist of the opening-and-closing member when the opening-and-closing member is opened and closed.

Eighth Aspect

In the sheet conveying device according to any one of the first to seventh aspects, the adjuster (e.g., the adjuster 30) adjusts at least one of the pressing force and the protrusion amount of the pressing member (e.g., the pressure roller 4) so that the tangential force at a contact portion (e.g., the contact portion C) acting on the contact portion between the lower end (e.g., the lower end 1*b*) of the tip slope (e.g., the tip slope 1*a*) of the hook (e.g., the hook 1) and the engaging member (e.g., the engagement shaft 2) is greater than a force (e.g., the holding force F3) of stopping sliding of the lower end of the tip slope on the outer circumferential surface of the engaging member. As described in the embodiment, such a configuration can prevent the half-closed state of the opening-and-closing member occurring.

Ninth Aspect

An image forming apparatus (e.g., the image forming apparatus 101) includes the sheet conveying device according to any one of the first to eighth aspects as a sheet conveying device. Such a configuration can reduce the occurrence of a half-closed state of the opening-and-closing member (e.g., the opening-and-closing cover 10) and the occurrence of a sheet jam due to the half-closed state of the opening-and-closing member.

The above-described embodiments are illustrative and do not limit the present disclosure. Thus, numerous additional modifications and variations are possible in light of the above teachings. For example, elements and/or features of different illustrative embodiments may be combined with each other and/or substituted for each other within the scope of the present disclosure. Any one of the above-described operations may be performed in various other ways, for example, in an order different from the one described above.

The invention claimed is:

1. A sheet conveying device comprising:

an opening-and-closing member having a lower end configured to be supported by an apparatus body, the opening-and-closing member configured to be rotatable to open and close a sheet conveyance path;

a pressing member included in the opening-and-closing member, the pressing member configured to press a pressed member of the apparatus body;

a hook configured to engage with an engaging member of the apparatus body, and to hold the opening-and-closing member at a closing position at which the opening-and-closing member closes the sheet conveyance path;

a biasing member configured to bias the hook in a direction to maintain engagement of the hook with the engaging member;

a first adjuster configured to adjust at least one of a pressing force of the pressing member or a protrusion amount of the pressing member with respect to a surrounding member of the pressing member; and a second adjuster, wherein the first adjuster and the second adjuster are on a first end and a second end, respectively, of the pressing member in an axial direction of the pressing member, and the first adjuster and the second adjuster are configured to be movable in a specified range with respect to the opening-and-closing member, the first adjuster and the second adjuster are configured to move to adjust at least one of the pressing force or the protrusion amount, and the hook is further configured to rotates against a biasing force of the biasing member, while sliding on the engaging member, to ride over the engaging member and engage with the engaging member.

2. The sheet conveying device according to claim 1, wherein the engaging member is a shaft; and the hook has a tip inclined with respect to a vertical direction.

3. The sheet conveying device according to claim 1, wherein, in an engaging operation in which the hook rides over the engaging member and engages with the engaging member while sliding on the engaging member:

the first adjuster is further configured to adjust the protrusion amount of the pressing member to an amount at which the pressing member contacts the pressed member before a contact portion of the hook with the engaging member reaches a top of the engaging member.

4. The sheet conveying device according to claim 1, wherein the pressed member is a conveying roller, the pressing member is a pressure roller, the surrounding member is a guide configured to guides a sheet, and the first adjuster is further configured to adjust the protrusion amount of the pressing member with respect to the guide.

5. The sheet conveying device according to claim 1, wherein the sheet conveying device further comprises:

a control panel configured to output a notification in response to a position of the first adjuster on the first end being different from a position of the second adjuster on the another second end.

6. The sheet conveying device according to claim 1, wherein the first adjuster is on the first end and the second adjuster is on the second end and are configured to move in conjunction with each other.

7. An image forming apparatus comprising the sheet conveying device according to claim 1.

8. The sheet conveying device according to claim 1, wherein the first adjuster and the second adjuster each further include a knob, the knob configured to adjust a position of the first adjuster or the second adjuster, respectively, in a vertical direction with respect to the pressing member.

9. The sheet conveying device according to claim 1, further comprising:

a second biasing member configured to bias the pressing member towards the pressed member.

10. A sheet conveying device comprising:

an opening-and-closing member having a lower end configured to be supported by an apparatus body, the opening-and-closing member configured to be rotatable to open and close a sheet conveyance path;

a pressing member included in the opening-and-closing member, the pressing member configured to press a pressed member of the apparatus body;

a hook configured to engage with an engaging member of the apparatus body, and to hold the opening-and-closing member at a closing position at which the opening-and-closing member closes the sheet conveyance path;

a biasing member configured to bias the hook in a direction to maintain engagement of the hook with the engaging member;

a first adjuster configured to adjust at least one of a pressing force of the pressing member or a protrusion amount of the pressing member with respect to a surrounding member of the pressing member; and a second adjuster, wherein the first adjuster and the second adjuster are on a first end and second end, respectively, in an axial direction of the pressing member, and the first adjuster and the second adjuster are configured to be movable in a specified range with respect to the opening-and-closing member, and the first adjuster and the second adjuster are further configured to move to switch at least one of the pressing force or the protrusion amount in a stepwise manner.

11. An image forming apparatus comprising the sheet conveying device according to claim 10.

12. The sheet conveying device according to claim 10, wherein the engaging member is a shaft; and the hook has a tip inclined with respect to a vertical direction.

13. The sheet conveying device according to claim 10, wherein, in an engaging operation in which the hook rides over the engaging member and engages with the engaging member while sliding on the engaging member:

the first adjuster is further configured to adjust the protrusion amount of the pressing member to an amount at which the pressing member contacts the pressed member before a contact portion of the hook with the engaging member reaches a top of the engaging member.

14. The sheet conveying device according to claim 10, wherein the pressed member is a conveying roller, the pressing member is a pressure roller, the surrounding member is a guide configured to guide a sheet, and the first adjuster is further configured to adjust the protrusion amount of the pressing member with respect to the guide.

15. The sheet conveying device according to claim 10, wherein the sheet conveying device further comprises:

a control panel configured to output a notification in response to a position of the first adjuster on the first end being different from a position of the second adjuster on the second end.

16. The sheet conveying device according to claim 10, wherein the first adjuster is on the first end and the second adjuster is on the second end and are configured to move in conjunction with each other.

17. The sheet conveying device according to claim 10, wherein the first adjuster and the second adjuster each further include a knob, the knob configured to adjust a position of the first adjuster or the second adjuster, respectively, in a vertical direction with respect to the pressing member.

18. The sheet conveying device according to claim 10, further comprising:

a second biasing member configured to bias the pressing member towards the pressed member.

19. A sheet conveying device comprising:

an opening-and-closing member having a lower end configured to be supported by an apparatus body, the opening-and-closing member configured to be rotatable to open and close a sheet conveyance path;

a pressing member included in the opening-and-closing member, the pressing member configured to press a pressed member of the apparatus body;

a hook configured to engage with an engaging member of the apparatus body, and to hold the opening-and-closing member at a closing position at which the opening-and-closing member closes the sheet conveyance path;

a biasing member configured to bias the hook in a direction to maintain engagement of the hook with the engaging member;

a first adjuster configured to adjust at least one of a pressing force of the pressing member or a protrusion amount of the pressing member with respect to a surrounding member of the pressing member; and a second adjuster, wherein the first adjuster is further configured to adjust at least one of the pressing force or the protrusion amount of the pressing member so that a tangential force at a contact portion between the hook and the engaging member is greater than a force of stopping sliding of the hook on an outer circumferential surface of the engaging member, the tangential force acting on the contact portion in response to the hook riding over the engaging member and engaging with the engaging member.

20. An image forming apparatus comprising the sheet conveying device according to claim 19.

* * * * *